United States Patent [19]

Smith

[11] 4,202,240

[45] May 13, 1980

[54] BRIDGE PIN

[76] Inventor: Gerald E. Smith, 1528 Waterhouse, Chattanooga, Tenn. 37412

[21] Appl. No.: 924,233

[22] Filed: Jul. 13, 1978

[51] Int. Cl.[2] ..... G10D 3/12

[52] U.S. Cl. ..... 84/297 R; 84/298

[58] Field of Search ..... 84/297 R, 298, 299, 84/307

[56] References Cited

U.S. PATENT DOCUMENTS

| | | | |
|---|---|---|---|
| 418,364 | 12/1889 | Bookser | 84/297 R |
| 572,677 | 12/1896 | Goodwin | 84/297 R |
| 976,428 | 11/1910 | Benson et al. | 84/298 |
| 2,029,135 | 1/1936 | Stanley et al. | 84/298 |
| 2,585,661 | 2/1952 | Kluson | 84/299 |
| 3,605,545 | 9/1971 | Rendell | 84/307 |
| 4,138,919 | 2/1979 | Miller | 84/297 R |

*Primary Examiner*—Lawrence R. Franklin

[57] ABSTRACT

An acoustic guitar having a plurality of strings each individually secured by a bridge pin at the bridge. Each pin has an enlarged head positioned on a stem secured to the guitar body through the bridgepiece. A bore extends through the head of the pin in the drection of the strings and has an enlarged counterbored portion at the tail-end. The anchoring element of each string is positioned within the counter-bored portion while the remainder of the string passes through the smaller bore and thence over the bridge nut. In one embodiment the side of the head has a slot that opens into the bore. In various embodiments the stem of the pin is secured to the guitar body by a nut threaded onto the stem, by a rib cooperating with grooves in a sleeve secured to the guitar or by a press fit.

10 Claims, 12 Drawing Figures

BRIDGE PIN

BACKGROUND OF THE INVENTION

This invention relates to guitars, and more particularly to bridge pins for securing of the strings on the guitar.

String securing arrangements of the prior art generally use a bridge pin with a groove cut longitudinally in the stem. The end of the string adjacent the ball or ring anchor is positioned within the groove and the anchor is trapped by the pin against the inner surface of the top of the guitar body. Such constructions are illustrated in U.S. Pat. Nos. 572,677; 976,428 and 3,605,545. With these arrangements when the strings are tuned by the tuning key, the strings twist about the anchoring point. This places excessive strain on the strings and they tend to break at this location. Moreover, as illustrated in this prior art, the pins have a tapered or conical stem which is pressed into the bridge piece and the guitar body. The bridge piece is glued to the body and the press fit provides small if any additional aid to securing the bridge piece which after a time loosen and come undone.

SUMMARY OF THE INVENTION

The primary object of this invention is to provide a guitar bridge pin which places less strain on the strings.

It is another object of this invention to provide guitar bridge pins which secure the strings without the strings engaging the body of the guitar thereby improving the sound.

It is a further object of this invention to provide a guitar bridge pin which may be secured to the bridge piece and guitar body in such a manner that a force is applied between the bridge piece and the guitar body to prevent loosening of the body piece.

In carrying out these objects the present invention provides a bridge pin having an enlarged head positioned on a stem. The head of the pin has a through bore extending in the longitudinal direction of the guitar. The tail portion of the bore is counter-bored for receiving the enlarged anchoring element of a string which is larger than the head portion of the bore. The string is thus secured within the pin and when tuned by the tuning key merely rotates within the bore without substantial twisting. Thus, the usual twisting strain on the string is eliminated. Moreover, since the string passes forwardly through the pin and need not be bent downwardly below the inner surface of the guitar body the bending strain on the string is also eliminated. In another form the string receiving opening may be a slot in the side of the pin head which opens into an enlarged bore at the tail end of the slot. The pins have stems which, since clearance for the anchor as in the prior art is unnecessary, can be threaded to receive a nut to secure the pin to the guitar body and thereby better secure the bridge piece. Moreover, the invention envisions the use of a locking sleeve to secure the pin, which sleeve aids in securing the bridge piece to the guitar body. The stem of the pin may have a rib which is adjustably positioned in one of a plurality of grooves within the sleeve.

The advantages and features of the invention will become apparent from the following description when taken in connection with the accompanying drawing, in which.

DESCRIPTION OF THE PREFERRED EMBODIMENTS

Figure 1:
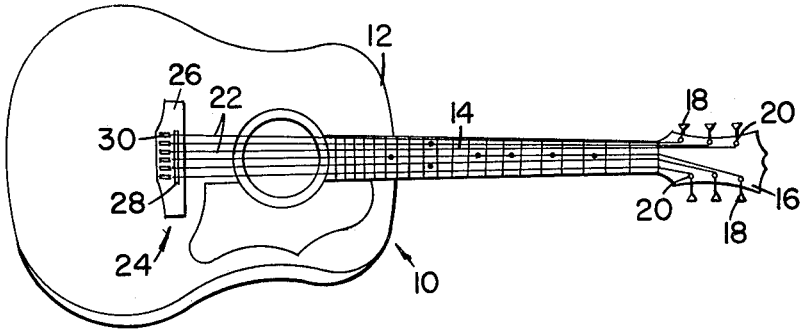
FIG. 1 is a plan view of a guitar having bridge pins constructed in accordance with the principles of this invention.
Figure 2:
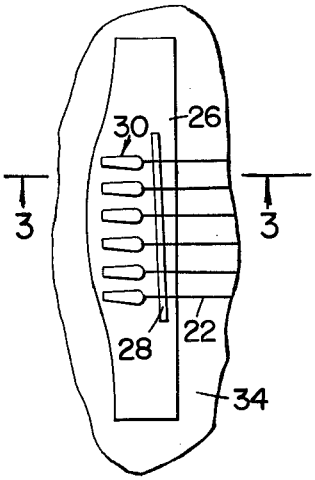
FIG. 2 is an enlarged fragmentary plan view of the bridge portion of the guitar of FIG. 1.

Referring now to the drawings FIG. 1 illustrates a conventionally shaped guitar 10 having a base or body portion 12 and a finger board 14 extending longitudinally therefrom and terminating in a head 16. The head has a plurality of tuning keys 18 each connected in a conventional manner for rotating a respective string post 20. A string 22 is conventionally connected to each post 20 at one end and extends longitudinally over the finger board 14 to a bridge 24 on the body 12. The bridge comprises a bridge piece 26 secured to the body 12 conventionally by glue and additionally by means hereinafter described. A bridge nut 28, over which the strings 22 pass is affixed to the bridge piece 26 and a bridge pin 30 for each string, hereinafter described in detail is located rearwardly of the bridge nut securing the tail-end of each string.

Figure 8:
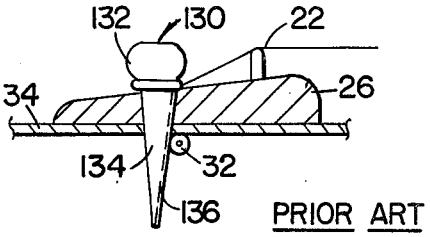
FIG. 8 is a view similar to FIG. 3, but of the prior art bridge pins.

Referring to FIG. 8, a bridge pin 130 of the prior art includes a bulbous head 132 and a conically tapered stem 134. A groove 136 extends longitudinally the length of the stem and the string 22 runs into the groove. Each string includes an anchor member in the form of a ball or ring 32 which is entrapped by the stem 134 and the inner surface of the top 34 of the guitar body 12. Thus, the string 22 is bent as it extends from the anchor 32 to the bulbous head 132. Moreover, since the anchor 32 is fixed, the string 22 twists as the corresponding string post 20 is rotated by the tuning key 18.

Figure 3:
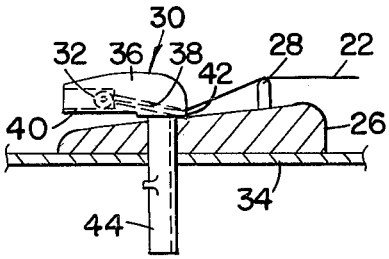
FIG. 3 is a cross sectional view taken substantially along line 3—3 of FIG. 2.

In an effort to correct this problem the bridge pins 30 of the present invention secure the string anchor 32 within a head 36 of the pin. As illustrated in FIG. 3 a channel in the form of a bore 38 extends through the head 36 in the longitudinal direction of the guitar. The bore 38 extends from the guitar head end at an upwardly inclined angle and opens into a larger bore 40 in the tail end of the pin head 36. The smaller bore 38 opens at a hole 42 at the intersection of the head 36 and an integral stem 44 of the pin 30. The bore 40 has a diameter of a size to receive the anchor 32; however, the bore 38 is smaller than the anchor, but larger than the diameter of the string 22. Thus, the string is secured in the bore and extends out the hole 42 at the conventional location relative to the bridge piece 26 and the bridge nut 28. The pins may comprise plastic, brass or aluminum, and each gives a different sound.

Figure 6:
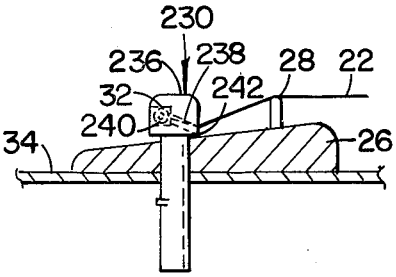
FIG. 6 is a view similar to FIG. 3 except the head of the bridge pin is of a different configuration.

The head of the pin 30 is illustrated in FIGS. 3–5,7, 9 and 10 as being elongated from front to rear, i.e., in the longitudinal direction of the strings. However, it is readily understood that the head need not be any larger than that required to secure the string end. Thus, in FIG. 6 a pin 230 having a substantially smaller head 236 is illustrated. In this embodiment the bore 238 and 240 are likewise shorter, but the angular relation between the hole 242 and the anchor 32 is greater than that provided between the hole 42 and the anchor in the embodiment of FIG. 3 and thus a greater strain may be encountered.

Figure 4:
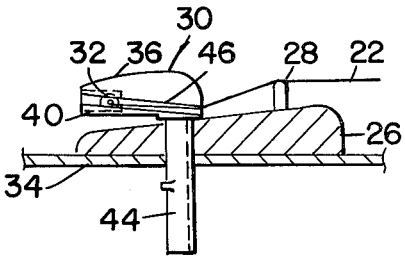
FIG. 4 is a view similar to FIG. 3 but of another form of the bridge pin.
Figure 5:
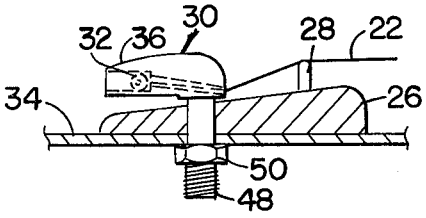
FIG. 5 is a view similar to FIG. 3 but with a threaded stem secured to the instrument by a nut.

In FIG. 4 the pin 30 has a slot 46 in the side of the head 36. The slot 46 opens laterally into the large bore 40 but takes the place of the bore 38 and thus allows for easier stringing of the guitar since the string need not be threaded through a hole but can be slipped into the slot 46.

Figure 9:
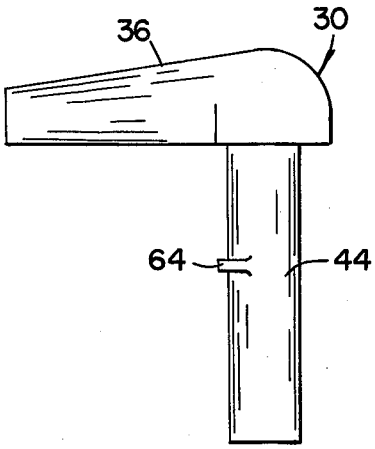
FIG. 9 is an enlarged side elevational view of the preferred form of the bridge pin.
Figure 10:
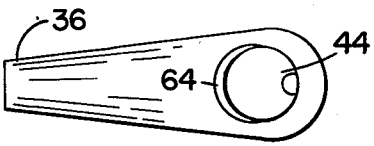
FIG. 10 is a bottom plane view of the pin of FIG. 9.
Figure 11:
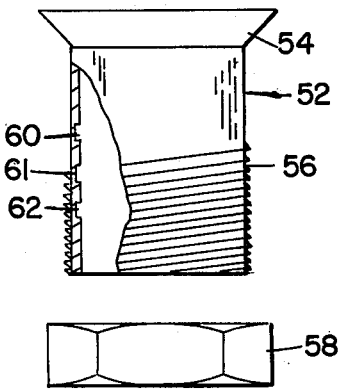
FIG. 11 is an elevational view partly in section illustrating a bridge pin locking sleeve and nut of the present invention.
Figure 12:
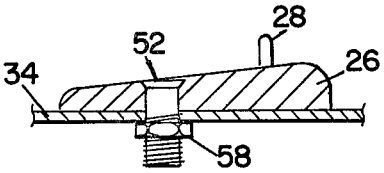
FIG. 12 is a fragmentary sectional view of the bridge portion of a guitar with the sleeve and nut affixed.

To secure the pin in the guitar the stem need only be press fitted as in the prior art. However, since the anchor 32 is not below the top 34, the stems may have threads as at 48 in FIG. 5 and a nut 50 threaded thereon. The nut 50 can thus bear on the top 34 to secure not only the bridge pin but the bridge piece 26 to the top 34 of the guitar body. Moreover, the present invention envisions a locking sleeve 52, as illustrated in FIG. 11, which can be utilized with either the pins of the present invention or with the prior art pins. The sleeve 52 is a cylindrical member having an enlarged upper periphical lip 54 and external threads 56 on the lower portion thereof for receiving a nut 58 to secure the sleeve to the bridge piece 26 and the top 34 respectively. The sleeve also has a series of grooves 60, 61,62 on a portion of the inner periphery. The pins may have a rib 64, as best illustrated in FIGS. 9 and 10, which are adapted to be retained within a selective groove 60,61,62. Thus, the pin may be positioned in the sleeve with the rib 64 90° to the grooves, adjusted to a desired height, and thereafter rotated so as to lock the rib into the corresponding groove.

Figure 7:
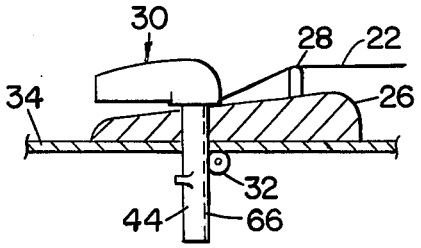
FIG. 7 is a view similar to FIG. 3, but illustrating the conventional manner of securing a string to a pin of the present invention.

As illustrated in FIG. 7 the pins 30 may have an elongated groove 66 in the stem 44 for a similar purpose as the pins of the prior art. This groove is unnecessary for purposes of the present invention but is illustrated to show the versatility of the present invention.

Numerous alterations of the structure herein disclosed will suggest themselves to those skilled in the art. However, it is to be understood that the present disclosure relates to the preferred embodiments of the invention which is for purposes of illustration only and not to be construed as a limitation of the invention. All such modifications which do not depart from the scope of the appended claims.

What is claimed is:

1. A bridge pin for securing an anchor of one longitudinally extending guitar string at the bridge of an acoustic guitar, said anchor being enlarged relative to the diameter of said string, said pin comprising an elongated mounting stem with a securing head thereon, said head having a string receiving channel extending in the longitudinal direction of said string, said channel comprising a first section opening at one end of the head and adapted to receive the anchor and string and a second section having a cross sectional dimension smaller than that of said first section, said second section opening at the opposite end of said head than said first section, said cross sectional dimension of said second section being such that the string but not the anchor is receivable therein.

2. A bridge pin as recited in claim 1 wherein said second section of said channel is inclined angularly toward said stem relative to said first section.

3. A bridge pin as recited in claim 1 wherein said stem extends from said head at said opposite end of said head, and said second section opens at the intersection of said head and said stem.

4. A bridge pin for securing an anchor of one longitudinally extending guitar string at the bridge of an acoustic guitar, said anchor being enlarged relative to the diameter of said string, said pin comprising an elongated mounting stem with a securing head thereon, said head having a bore extending therethrough in the longitudinal direction of said string, said bore comprising a first section opening at one end of the head in the trailing direction relative to said string and of a diameter adapted to receive the anchor and string, and a second section having a smaller diameter than that of the first section opening at the end of the head in the leading direction relative to said string, said second section being adapted to receive said string but not the anchor.

5. A bridge pin as recited in claim 4 wherein said stem is threaded for receiving a nut thereon.

6. A bridge pin as recited in claim 4 wherein said stem extends from said head at said leading end of said head, and said second section opens at the intersection of said head and said stem.

7. A bridge pin as recited in claim 4 wherein said second section of said bore is inclined angularly toward said stem relative to said first section.

8. A bridge pin for securing an anchor of one longitudinally extending guitar string at the bridge of an acoustic guitar, said anchor being enlarged relative to the diameter of said string, said pin comprising an elongated mounting stem with a securing head thereon, said head having a string receiving slot in a side wall thereof extending in the longitudinal direction of said string the length of said head, a bore in the rear surface of said head relative to said string extending longitudinally partly through said head, said bore having a diameter adapted to receive the anchor, said slot opening into said bore and being of a size to receive said string but not said anchor.

9. A bridge pin as recited in claim 8 wherein said stem is threaded for receiving a nut thereon.

10. A bridge pin as recited in claim 8 wherein said slot is inclined angularly toward said stem relative to said bore.

* * * * *